US007589706B2

(12) United States Patent
Chou

(10) Patent No.: US 7,589,706 B2
(45) Date of Patent: Sep. 15, 2009

(54) ACTIVE MATRIX LIGHT EMITTING DEVICE DISPLAY AND DRIVE METHOD THEREOF

(76) Inventor: Chen-Jean Chou, 21 Ridgefield Rd., New City, NY (US) 10956

( * ) Notice: Subject to any disclaimer, the term of this patent is extended or adjusted under 35 U.S.C. 154(b) by 622 days.

(21) Appl. No.: 11/162,270

(22) Filed: Sep. 4, 2005

(65) Prior Publication Data

US 2006/0050040 A1 Mar. 9, 2006

Related U.S. Application Data

(60) Provisional application No. 60/522,239, filed on Sep. 3, 2004.

(51) Int. Cl.
*G09G 3/36* (2006.01)

(52) U.S. Cl. ..... 345/92

(58) Field of Classification Search ..... 345/36, 345/39, 42, 46, 48, 82, 90, 92
See application file for complete search history.

(56) References Cited

U.S. PATENT DOCUMENTS 5,408,109 A 4/1995 Heeger et al. ..... 257/40
5,482,896 A 1/1996 Tang ..... 438/28
5,663,573 A 9/1997 Epstein et al. ..... 257/40
5,684,365 A 11/1997 Tang et al. ..... 315/169
5,952,789 A 9/1999 Stewart et al. ..... 315/169
6,157,356 A 12/2000 Troutman ..... 345/28
6,501,466 B1 * 12/2002 Yamagishi et al. ..... 345/204
6,580,408 B1 6/2003 Bae et al. ..... 345/76
6,618,030 B2 9/2003 Kane et al. ..... 345/82
6,621,100 B2 9/2003 Epstein et al. ..... 257/40
6,686,699 B2 2/2004 Yumoto ..... 315/169
6,734,636 B2 5/2004 Sanford et al. ..... 315/169

* cited by examiner

*Primary Examiner*—Sumati Lefkowitz
*Assistant Examiner*—Tammy Pham

(57) ABSTRACT

Drive method and pixel circuits comprising a direct current path between a scan electrode and a data electrode are disclosed. Preferred embodiments of said pixel circuit are provided for the application to convert current signal received from a data electrode to voltage signal for current-control drive. In such preferred embodiments, light emitting device displays are operated in current-control mode without being influenced by variations in threshold voltage of transistor and forward voltage of light emitting element. Further extension and applications are described. Preferred embodiments leading to three-transistor solution of such operation are disclosed.

37 Claims, 14 Drawing Sheets

100

ACTIVE MATRIX LIGHT EMITTING DEVICE DISPLAY AND DRIVE METHOD THEREOF

CROSS REFERENCE

The present application claims the benefit of U.S. Provisional Patent Application No. 60/522,239, filed on Sep. 3, 2004, which is hereby incorporated by reference.

BACKGROUND OF THE INVENTION

1. Field of the Invention

The present invention relates to the pixel circuits and drive method of an active matrix display comprising light-emitting devices that emits light by conducting a driving current through a light emitting material such as an organic semiconductor thin film. Such pixel circuits comprise active elements, such as thin film transistors, for controlling the light emitting operation of the respective light emitting devices. More specifically, the present invention provides pixel circuits comprising an active conducting channel between a data input electrode and a scan electrode, and a method to operate such pixel circuits. Furthermore, pixel circuits in the present invention are structured with alternating conducting channels, controlled by a multi-functional control electrode. Pixel circuits capable of performing current-controlled drive scheme, with reduced complexity than existing solutions, are provided as preferred application of the present invention.

2. Description of the Prior Art

Organic light emitting diode displays (OLED) have attracted significant interests in commercial application in recent years. Its excellent form factor, fast response time, lighter weight, low operating voltage, and prints-like image quality make it the ideal display devices for a wide range of application from cell phone screen to large screen TV. Passive OLED displays, with relatively low resolution, have already been integrated into commercial cell phone products. Next generation devices with higher resolution and higher performance using active matrix OLEDs are being developed. Initial introduction of active matrix OLED displays have been seen in such products as digital camera and small portable video devices. Demonstration of OLED displays in large size screens further propels the development of a commercially viable active matrix OLED technology. The major challenges in achieving such a commercialization include (1) improving the material and device operating life, and (2) reducing device variation across the display area. Several methods have been suggested to address the second issue by including more active switching devices in individual pixels, by switching of power supply lines externally, or by reading back the pixel parameters combined with an external memory and tuning circuit. As more elaborated control circuits being incorporated into individual pixels as proposed in these solutions, concerns over complexity and practical manufacturing issues arise.

The operation of an OLED display differs from a liquid crystal display (LCD) in that each and every pixel in an OLED display comprises a light emitting element. The light output of such light emitting elements is more conveniently controlled by the current directed to the pixel. In contrast, an LCD is readily operable by voltage signals as its optical response being more favorably expressed in a simple form of applied voltage. While typical storage devices hold information in the form of voltage, operating an active matrix OLED display via a typical storage element requires a conversion mechanism within a pixel to convert a stored voltage data into specific current output. In practice, a conversion method needs to be reliable and fairly independent of such factors as pixel-to-pixel variation in the characteristics that affect said conversion, to make an OLED display operable with fair uniformity.

Basic examples of using organic material to form an LED are found in U.S. Pat. No. 5,482,896, U.S. Pat. No. 5,408,109 and U.S. Pat. No. 5,663,573, and examples of using organic light emitting diode to form active matrix display devices are found in U.S. Pat. No. 5,684,365 and U.S. Pat. No. 6,157,356, all of which are hereby incorporated by reference.

An active matrix OLED display (FIG. 1) is typically structured with "SELECT" electrodes for row select, "DATA" electrodes for setting the pixel state, power electrodes VDD to drive the pixels, and a reference voltage VREF to provide a common voltage level. A basic pixel in an active matrix display also comprises at least one transistor for data control, and at least a storage element to hold the data information sufficiently long so a pixel remains stable in a data state in an image frame. A circuit diagram for a basic pixel 100 in an active matrix OLED display is depicted in FIG. 2 in further detail. An active matrix display with pixel circuit structured as in FIG. 2 allows data to be written and retained in a storage capacitor 204 according to the data signal delivered from a data electrode in an address cycle, while the power supply VDD continuously drives OLED 205 through an n-channel transistor 201, according to the data setting in capacitor 204. The selection of pixels to receive data information is controlled by an n-channel transistor 203 that is controlled by the voltage on a select electrode connected to the gate of transistor 203. An active matrix driving scheme allows the drive transistor 201 remain in a data state, and continue to deliver the required drive current, for an extended period of time after the input data on the data electrode is disconnected from the pixel. The peak current required for achieving a certain brightness level is thus reduced accordingly compared to a passive matrix. The peak driving current in an active matrix display does not scale with the resolution as in a passive matrix, making it suitable for high resolution applications. Stability of the active matrix display is also improved appreciably.

As illustrated in the above example, the electrical current for producing light output is directed to the light emitting element via a current path that comprises at least a control element that regulates the current. In a conventional light emitting device display, these control elements are fabricated on a thin film of amorphous silicon on glass. Power consumed in such control elements are converted to heat rather than yielding any light. To reduce such power consumption, polycrystalline silicon is preferred over amorphous silicon for its better mobility. More elaborated methods employing self-regulated multiple-stage conversions suitable for pixel circuit using polysilicon base material may be found in U.S. Pat. No. 6,501,466 and U.S. Pat. No. 6,580,408. These methods provide a current drive scheme while largely eliminated the impact from material and transistor non-uniformity typically associated with thin film polysilicon on glass base plate. In these methods, typically a minimum of four transistors are required to achieve such self-regulated, multi-stage conversion to achieve a pixel-independent current drive for the light emitting device display. An example of such methods is illustrated in FIG. 3. where four transistors 301, 302, 303, and 307, and 3 access electrodes, DATA, SELECT, and VDD, are used for each pixel with a storage capacitor 304 and an OLED 305.

The circuit in FIG. 4 illustrates another method for a self-regulating current drive scheme. The display circuit includes a switch on a power supply electrode, switching the source voltage between two voltage levels VDD1 and VDD2. Comparing to the example of FIG. 3, the transistor count of FIG. 4 is less than that of FIG. 3, but an additional access electrode with switching capability is required to operate the pixel and to deliver drive current to the light emitting diode in a current drive scheme.

FIG. 5 illustrates another method that reads the pixel parameters into an external processing circuit that comprises memory and adjustment circuitry. The variations of pixel parameters, such as the threshold voltage variation, may be eliminated by such external adjustment. The pixel circuit comprises five transistors and five access electrodes.

These examples of prior art provide a brief overview of the existing solutions considered in the art to resolve the uniformity issue. Comparing to the basic pixel circuit in FIG. 2, it is evident that any current solution to the uniformity issue involves a substantial increase in the complexity of pixel circuit, and thus likelihood of reduction of available light emitting area, efficiency, and product yield.

The present invention provides a multi-functional scan electrode for pixel access that carries the conventional pixel select function and providing a conversion function for converting a data current to a data voltage. The present invention further provides multiple conducting channels in a pixel, for setting the data voltage and delivering drive current. The pixel structure so constructed comprises a direct current path from a data electrode to a scan electrode, and may further comprise a direct current path from a scan-power electrode to the light emitting element. The turning-on and off of such channels are fully controlled by the voltage applied on a scan-power electrode.

SUMMARY OF THE INVENTION

In a conventional pixel driving circuit, a scanning electrode carries a scanning function of turning on and off control switches in a pixel to enable or disengage data input from data electrodes. Such scanning electrodes do not participate in setting actual value of data information to a storage element in the pixel, and do not communicate with data electrode directly. The present invention provides a pixel circuit for an active matrix light emitting device display comprising a multi-functional scan electrode. The present invention further provides a method for driving an active matrix light emitting device display wherein a scanning electrode directly communicate with data electrodes during a scanning operation, and provides reference voltage to set actual data value in the pixel.

The present invention provides pixel circuits and a drive method to operate said pixel circuits, where a pixel comprises a conducting channel between a data electrode and a scanning electrode; the enabling and inhibiting of such conducting channel are fully operated by the control signal voltages applied to the scan electrode. Furthermore, a pixel circuit comprising two alternating conducting channels, one between a data electrode and a scan electrode, and the other between a scan electrode and said reference voltage source via said light emitting element, are provided as an extension in the present invention.

As a preferred embodiment of the present invention, the conducting channel between a data electrode and a scan electrode is structured to convert a data current directed thereto to a data voltage to be stored at a storage element. Such stored data voltage controls a drive current to the light emitting element in a pixel. The conducting channel between a scan electrode and a reference voltage source provides a means to supply drive current via a scan electrode (in this case, named herein as a scan-power electrode) to the light emitting element, making a pixel circuit more compact and allowing additional control functions to be incorporated in a single control electrode.

Preferred embodiments of the present invention are provided for the operation of a display in current drive scheme to eliminate dependency on threshold voltage variation and OLED characteristics. The present invention also utilizes a drive method that merges conventional power delivering electrode and scanning electrode into a single access electrode (scan-power electrode). Preferred embodiments in three-transistor implementation are provided to illustrate the application to the solutions for current drive scheme within the present invention. Additional embodiments are provided as illustration of a broader implementation principle.

Additional features and advantages of the present invention will be set forth in the description which follows, or may be learned by practice of the invention. The objectives and other advantages of the invention will be realized and attained by the structure particularly pointed out in the written description and claims hereof as well as the drawings.

DETAILED DESCRIPTION OF THE INVENTION

Figure 1:
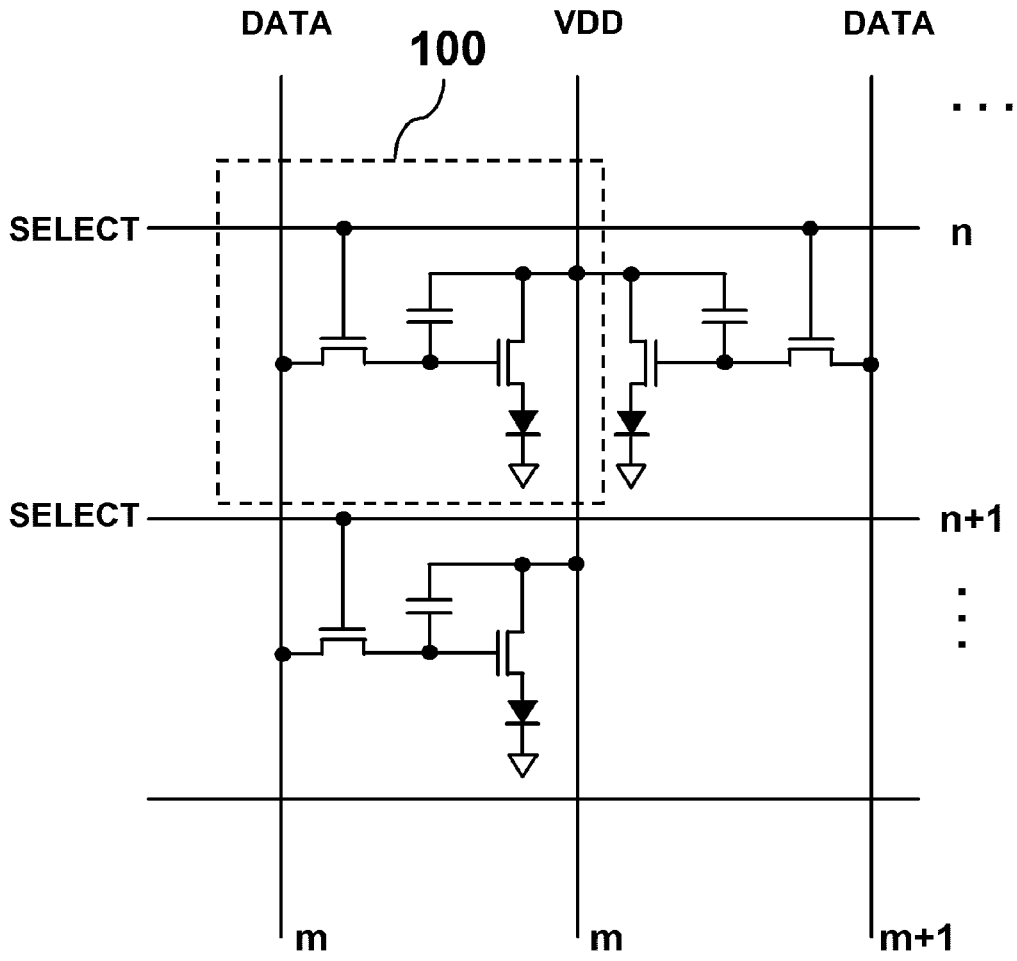
Fig. 1 (Prior Art)
FIG. 1 is a schematic of a prior art active matrix light emitting device display.
Figure 2:
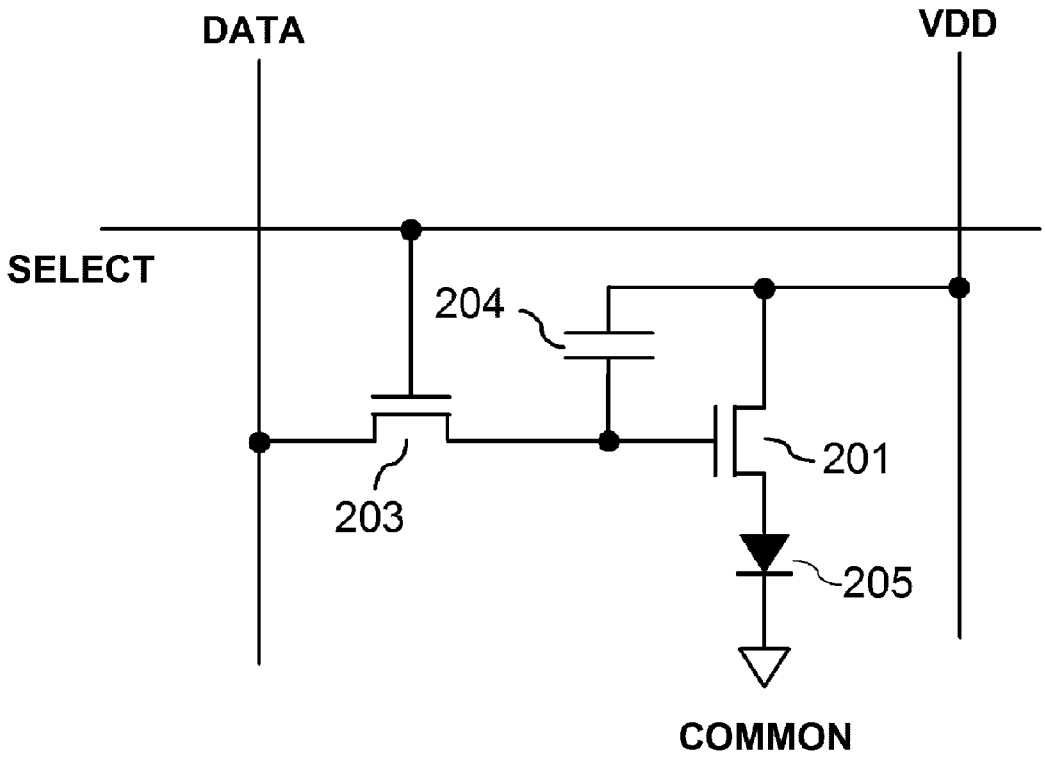
Fig. 2 (Prior Art)
FIG. 2 is a schematic of a prior art pixel circuit in an active matrix light emitting device.
Figure 3:
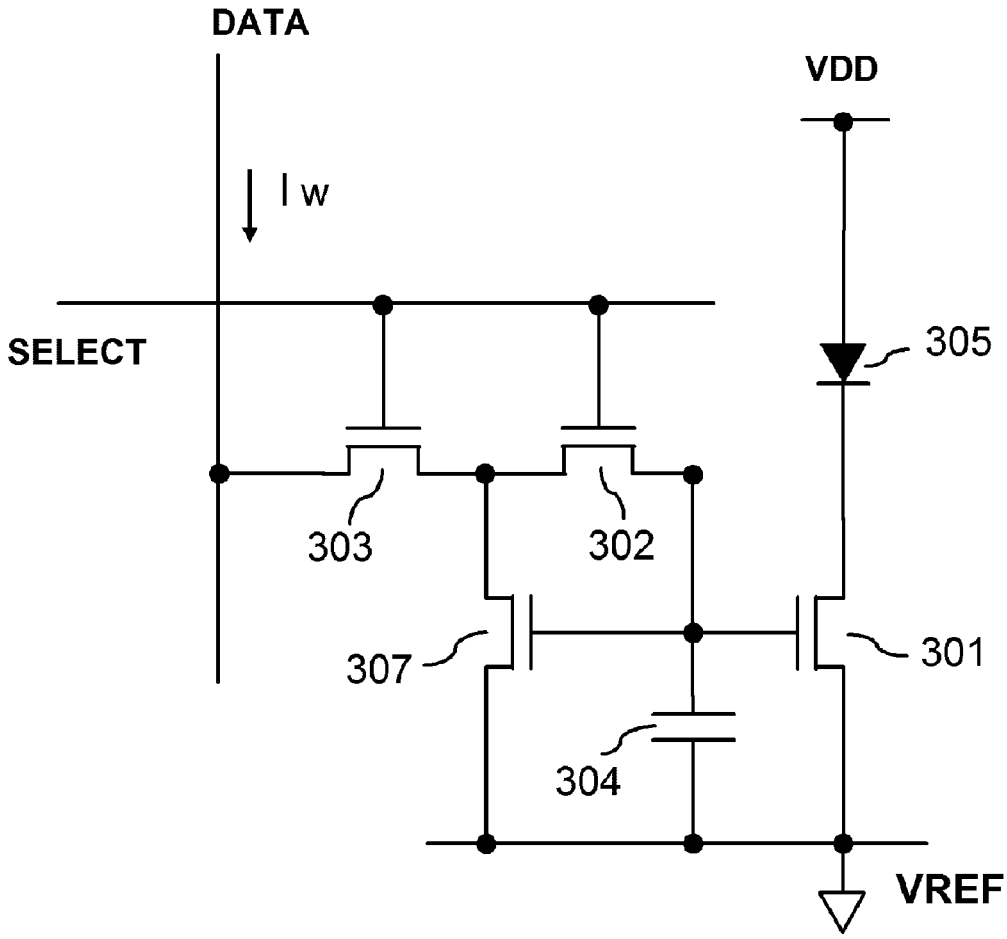
Fig. 3 (Prior Art)
FIG. 3 is a schematic of a prior art pixel circuit in an active matrix light emitting device.
Figure 4:
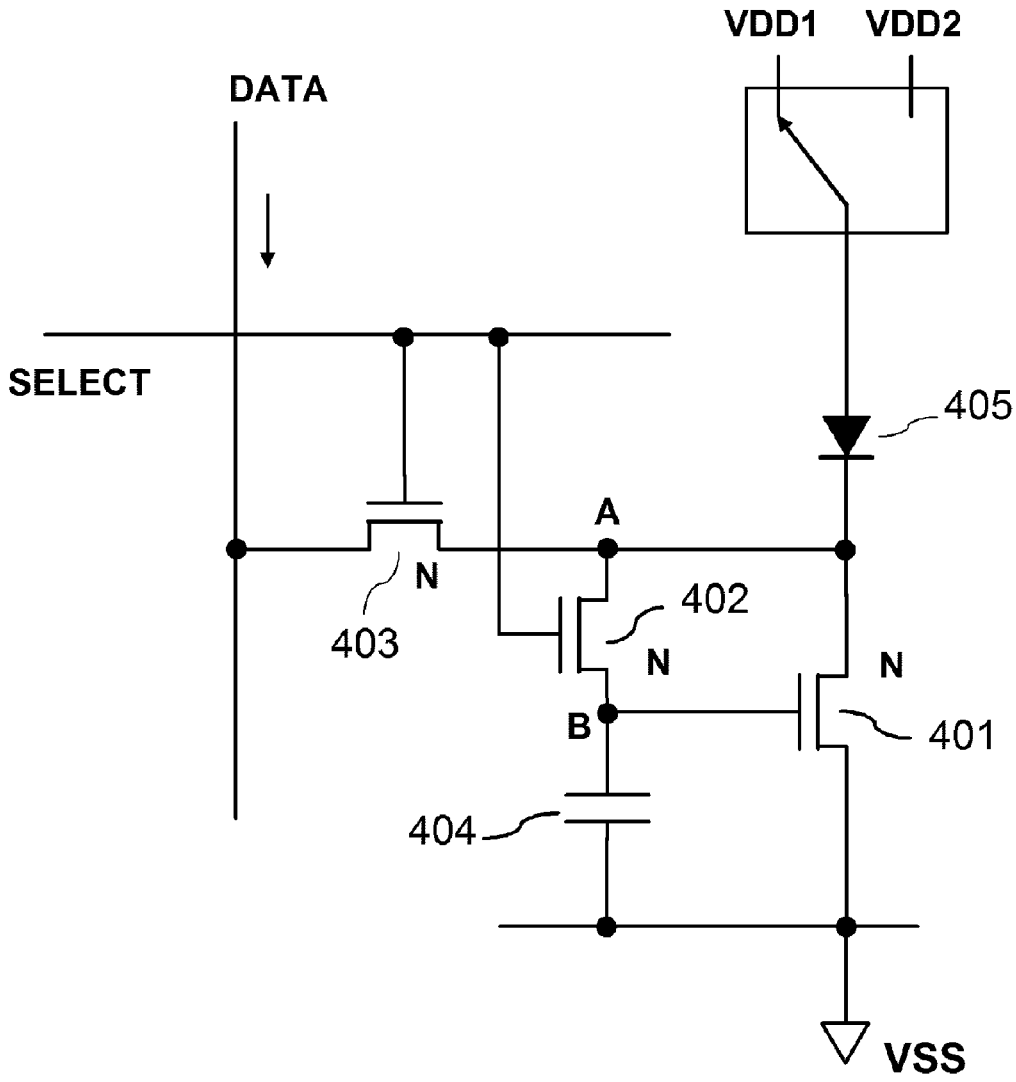
Fig. 4 (Prior Art)
FIG. 4 is a schematic of a prior art pixel circuit in an active matrix light emitting device.
Figure 5:
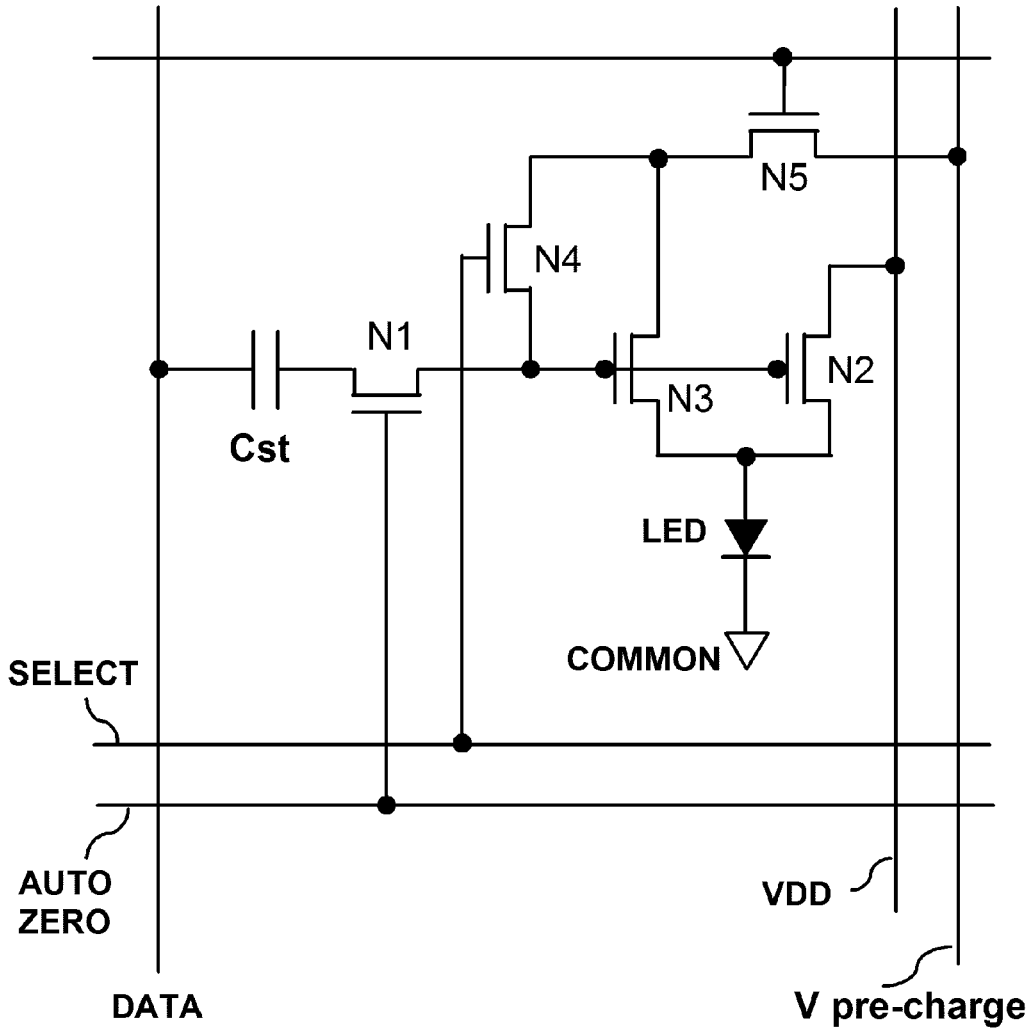
Fig. 5 (Prior Art)
FIG. 5 is a schematic of a prior art pixel circuit in an active matrix light emitting device.

The present invention and claimed subjects disclosed herein are directed to the operation of active matrix light emitting device display.

The present invention provides active matrix pixel circuits and a method to drive such. The circuit comprises a conducting channel between a data electrode and a scan electrode, controlled by the signal applied to scan electrode. Furthermore, the present invention provides two conducting channels in a pixel, enabled alternately by the signals applied to the same scan control electrode, where the second conducting channel provides current to drive a light emitting element in a pixel. A conventional scan electrode thus operates to perform both a scanning function and a power delivery function, and referred to as scan-power electrode in such embodiments. Preferred embodiments of the present invention are provided for the current drive scheme to eliminate dependency on threshold voltage variation and OLED characteristics. Preferred embodiments in three transistor implementation are provided to illustrate the solutions for current drive scheme within the present invention. Additional embodiments are provided as illustration of a broader implementation principle.

Preferred embodiments of the present invention are herein described using organic light emitting diodes as illustration. Examples of using organic material to form an LED are found in U.S. Pat. No. 5,482,896 and U.S. Pat. No. 5,408,109, and examples of using organic light emitting diode to form active matrix display devices are found in U.S. Pat. No. 5,684,365 and U.S. Pat. No. 6,157,356, all of which are hereby incorporated by reference.

As evidenced in the prior art, the conventional method of constructing and operating a light emitting device display involves a scanning electrode (or referred to as SELECT electrode, GATE electrode, or other names carrying similar meaning) and a power supply electrode (VDD). The scanning electrode interacts with a pixel through high impedance gates of switching elements in the pixel and does not participate in delivering drive current to the light emitting device.

The present invention provides pixel circuits and operating method that a current is directed to a conducting channel between a data electrode and a scan electrode. Such conducting channel is controlled according to a signal voltage applied to the scan electrode and may be arranged to provide a conversion function to convert a input current into a voltage, and set an internal storage element to said voltage.

The present invention further combines with a scan-power electrode that operates to deliver drive power via a scan electrode. The same electrode that selects a pixel for data writing delivers a full amount of drive current in a subsequent operating period. A pixel so constructed utilizes a scan-power electrode that delivers drive current while inhibiting data transfer between said data electrode and said pixel in one period, and enables data writing from data electrode into said pixel according a scanning signal in another period.

A pixel so constructed comprises a conducting channel between a data electrode and a scan electrode (now referred to as DS). A combined circuit further comprises a second conducting channel (now referred to as SP) between a scan-power electrode and the voltage source that supplies the drive power to the light emitting device in a the pixel. The enabling and inhibiting of conducting channel SP are fully controlled by voltage signals applied to the scan-power electrode.

The channel DS is also referred to as the first conducting channel, and channel SP is referred to as the second conducting channel.

A scan-power electrode represents an access electrode that is structured to perform both a scanning operation where a scanning signal is delivered to enable data input in selected pixels in one period of the operation, and a drive operation where a drive current is delivered to a light emitting device in another period of operation. A scan electrode represents an access electrode that performs a scanning (or select) operation. A scanning (or data writing) cycle is a period that a pixel is selected to allow data to be transferred from a data electrode to the selected pixel. The transferred data information is stored in a storage element in the pixel thereafter until the next scanning period.

In the description of this invention, a direct current path is a current path not interrupted by or ended on a capacitor; it may comprise such elements as resistor, drain-to-source and emitter-to-collector channel of a transistor, anode-to-cathode of a diode, and conductive lines that allow a current to continue. A direct current path in this description implies that it is enabled and conducts intended current in at least one of the operation periods for operating a display device. A charging current ended on or via a capacitor does not constitute a direct current path. Transient currents arising from charging of input gate or parasitic capacitors are not considered as providing valid current path. The reverse leakage of a diode, the leakage current in a transistor in its off-state, and current via the high impedance input terminals (such as a base or a gate) are also not considered as valid current paths. Accordingly, a direct current path in this description is a current path that allows the conduction of an intended current for the purpose of operating a display pixel, and allows such current to continue for as long as the set conditions persist.

An active element comprises a high-impedance control terminal and a channel between a second terminal and a third terminal. In operation, said high-impedance control terminal receives a control signal and regulates the current directed along said channel according to the control signal. A preferred embodiment of an active element is an MOS transistor having a gate as the control terminal, and a channel between the other two terminals arranged as source and drain. Similarly, bipolar transistors and JFETs are alternatives as preferred embodiments. The results for all these active elements are similar, and may be exemplified by the operation of MOS devices.

An organic light emitting diode (OLED) is used in most preferred embodiments wherever appropriate; the presence of such a device in such embodiments should not be construed as setting forth a limitation on the present invention directed for light emitting devices in general. MOS devices are used in preferred embodiments for switching elements. Similar bipolar transistors will perform similar functions as MOS devices. Those skilled in the art can quickly derive variations by a substitution of an arbitrary light emitting device for the organic light emitting diode, or by different types and polarities of switching devices. Preferred operating condition and preferred input data format do not necessitate limitations on the operation of the present invention.

Preferred embodiments of the present invention will hereinafter be described in detail with reference to the drawings.

Figure 6:
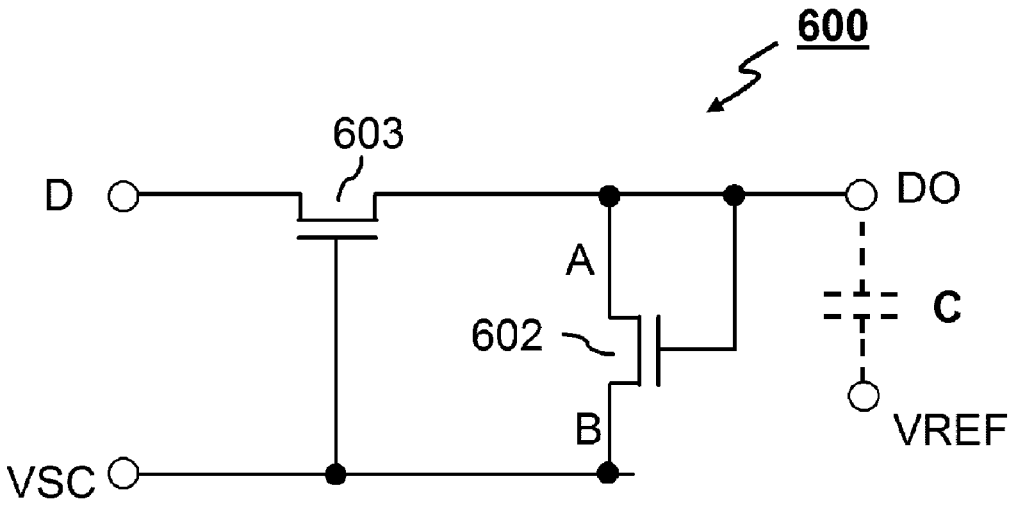
FIG. 6 is a schematic diagram of a preferred embodiment of a data control circuitry in the present invention.

A preferred embodiment of a circuit element is provided in FIG. 6 to illustrate a conducting channel between a data electrode (D) and a scan electrode (VSC), wherein two transistors 602 and 603 are connected along the conducting path. The gate of 602 is connected to one of the two source-drain terminals, terminal A, of 602. The gate of transistor 603 is directly controlled by the scan electrode VSC. The conducting channel from VSC to D via B and A provides a direct current path when both transistors are turned on.

In a preferred implementation, 602 may be assigned an n-channel transistor, and 603 a p-channel transistor. Terminal A operates as the source and B as the drain of n-channel transistor 602 when VSC is positive with respect to D; terminal A operates as the drain and B as the sourced when VSC is negative relative to D. By setting VSC substantially more negative (typically a few volts) than D, p-channel transistor 603 is turned on. A positive voltage on B-terminal makes B-terminal a source and A-terminal a drain of transistor 602.

Furthermore, $V_{GS}=V_{DS}$ as provided by the circuit connection, transistor 602 is turned on and set in its saturation region. Furthermore, the value of $V_{DS}$ is uniquely determined by the current directed from VSC to D since transistor 602 operates in its saturation point ($V_{GS}=V_{DS}$) as a two terminal device.

When VSC is set higher (more positive) than D, p-channel 603 is turned off. Transistor 603 is also set to its off state since A-terminal is settled at a divided voltage between 602 and 603, and is negative compared to B terminal. Such a configuration provides a gate-to-source short in 602. A proper operating condition for circuit 600 requires a scanning voltage VSC being switched between a $V_{HI}$ and a $V_{LO}$, where the voltage difference between high and low exceeds a combined dynamic range covering both the dynamic voltage range of data signal and the voltage range of VREF. The reference voltage VREF for capacitor may be a dynamically varying voltage level in pixel operation.

The embodiment described in FIG. 6 provides the followings:

A conducting channel between a data electrode and a scan electrode;

Said conducting channel being controlled by setting a voltage high or a voltage low on the scan electrode VSC;

A conversion from current input to a voltage output according to a saturation condition of a transistor;

A specific prescription in this transfer characteristics is that the output voltage is determined by an input current unambiguously according to the above mentioned conditions.

Figure 7A:
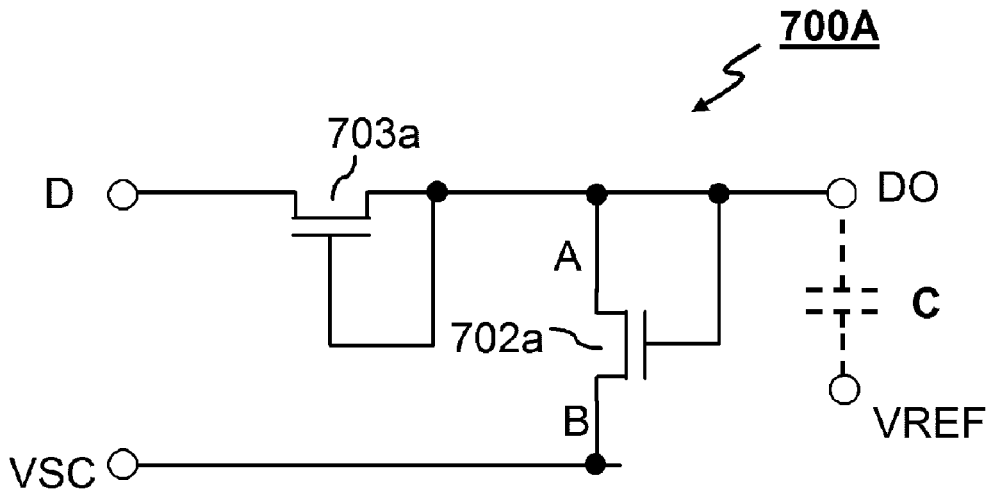
FIG. 7A is a schematic diagram of a preferred embodiment of a data control circuitry in the present invention.
Figure 7B:
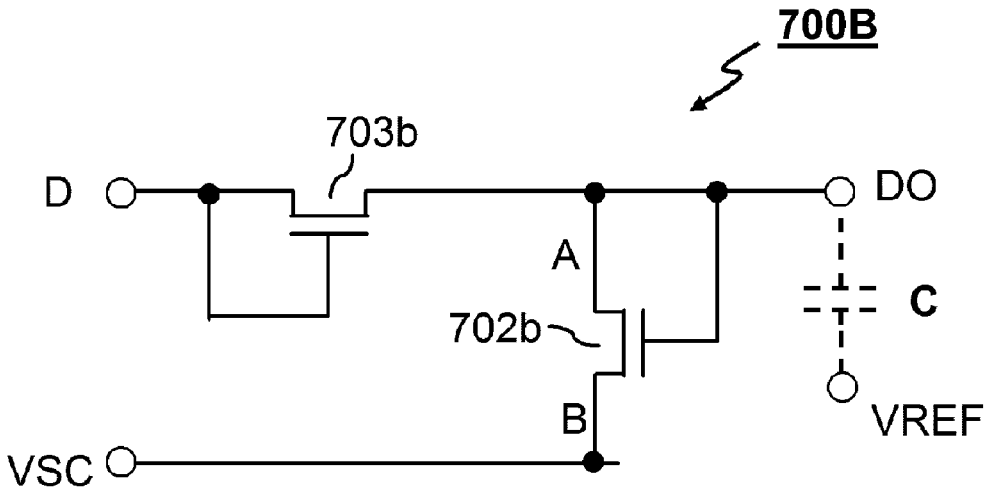
FIG. 7B is a schematic diagram of a preferred embodiment of a data control circuitry in the present invention.

Additional preferred embodiments of a conducting channel between a data electrode and a scan electrode are provided in FIGS. 7A and 7B. In FIG. 7A, two transistors are arranged along the conducting path between scan electrode VSC and the data electrode D. The gate terminals of both transistors are connected to a source-drain terminal. In a preferred operation, one transistor is an n-channel transistor, and the other a p-channel transistor. Given an n-channel 702*a* and *p*-channel 703*a*, the conducting channel is enabled when the voltage at VSC is set lower than the voltage at D, turning on the p-channel 703*a* and n-channel 702*a*, and inhibited when voltage is reversed. The operation and voltage conversion may be derived in analogy to that provided above for FIG. 6.

FIG. 7B provides a variation from FIG. 7A where the two transistors are arranged to be in the same orientation. Operations similar to that of FIG. 6 and FIG. 7A may be derived in analogy to FIG. 6 in a preferred embodiment where transistors 702*b* and 703*b* are either both n-channel or both p-channel transistors.

Figure 8:
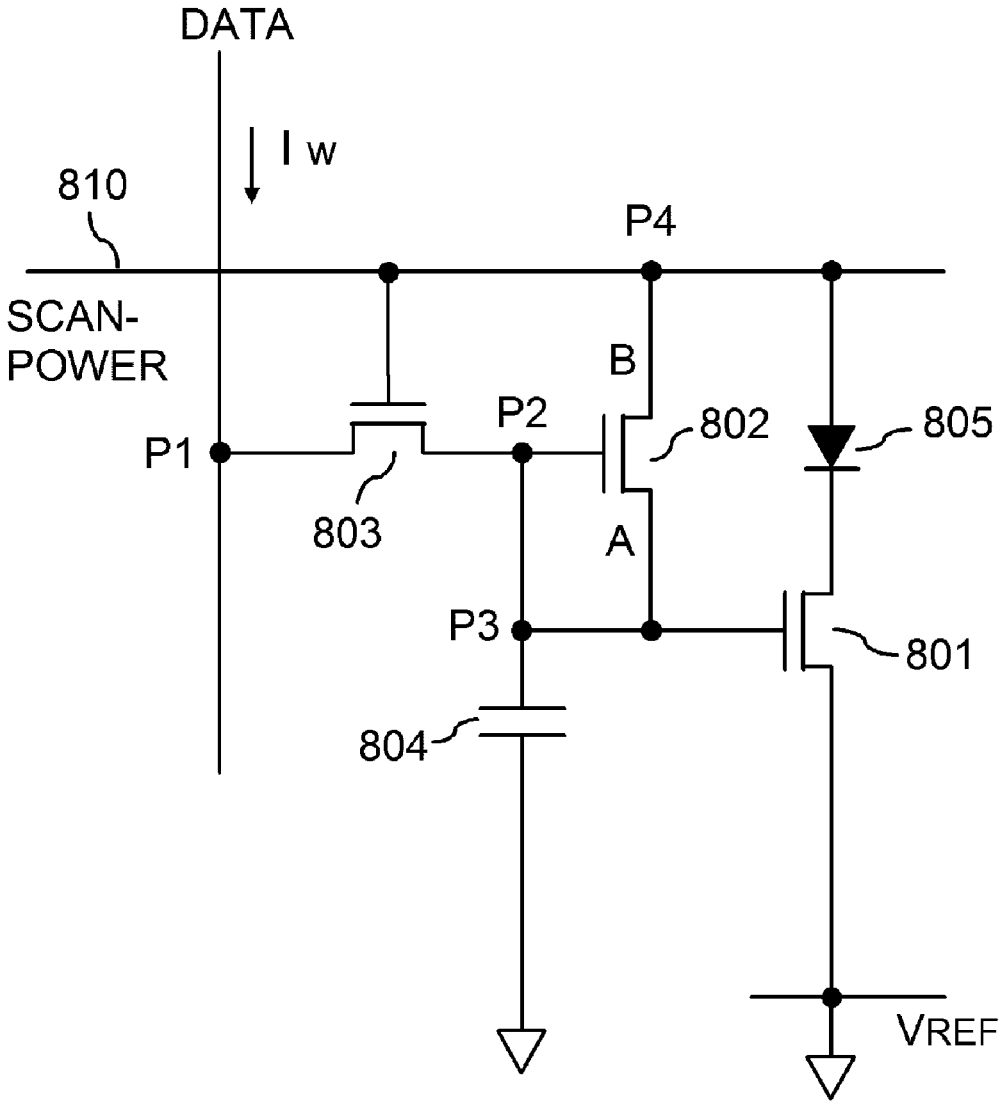
FIG. 8 is a schematic diagram of a pixel circuit in a preferred embodiment incorporating a data control circuitry in the present invention.

FIG. 8 provides an example of a preferred embodiment of a pixel circuit comprising the circuit element of FIG. 6, wherein the equivalent of 602 and 603 are provided as 802 and 803, and wherein a storage capacitor 804 is provided. The storage capacitor 804 is connected to the gate of transistor 801 to provide data information for the control of a current directed to the light emitting element 805.

A preferred implementation of FIG. 8 provides a p-channel transistor 803, and n-channel transistors 801 and 802. The voltage of scan-power electrode is pulsed between $V_{LO}$ and $V_{HI}$, where $V_{HI}$ is the most positive voltage in the system, and $V_{LO}$ is the lowest voltage level in the system. A typical value of $V_{HI}$ is the sum of maximum voltage appearing on the data electrodes and the maximum forward voltage drop on light emitting element 805, with respect to $V_{LO}$. $V_{LO}$ is conveniently set to VREF, and is the ground voltage of the system. Taking polymer light emitting diode as an example (for 805), a typical forward voltage drop for active matrix application is within 5V, and a dynamic data range is within 5V. Setting $V_{LO}$ as ground level (0V), the scan-power electrode will then be pulsed between 0 and 10V in an actual operation of such active matrix displays.

With reference to the circuit of FIG. 8, in a preferred operation, data information is formatted in a form of current source $I_W$. The operation of said circuit is described hereinafter:

1. Data signal and desired output. When a current is direct to an OLED, its light output may be closely represented as linear to the drive current. In order to maintain a uniform control of light output that is not disturbed by variation from pixel to pixel, it is convenient to devise a pixel circuit that provides a transfer function converting input signal from a data electrode linearly into output current on OLED. Such a transfer function needs to be independent of variation of major parameters in a pixel circuit such as threshold voltage of control transistors and forward operating voltage of OLED. A drive method by formatting the data information into respective current value externally and delivering such current to the respective pixels has shown more promise than driving in voltage form. Here the description of operation will be developed along a current drive principle, using a current source $I_W$ delivered on a data electrode to produce a current output $I_D$ on an OLED. A preferred circuit and its operation are expected to produce an output current in a drive cycle that is linear to input current in the scanning cycle.

2. Scan and data writing cycle. A voltage low $V_{LO}$ (scanning voltage) for selecting pixels for data input is applied to a scan-power electrode 810, turning on p-channel transistor 803 and allowing data current $I_W$ to enter the pixel, where $V_{LO}$ is equal to VREF, and is set to be the lowest potential in a display system. As input data current Iw is directed toward the gate of n-channel 802 and capacitor 804, a non-zero current causes a continued accumulation of positive charge (and voltage) on capacitor 804 and on the gate of transistor 802, thereby turning on 802 to allow a current diversion through 802 for the circuit to approach a steady state. Since B-terminal of 802 is set to VLO that is the lowest voltage level of the system, A and B terminals operate as drain and source of 802, respectively, as discussed above regarding FIG. 6. Transistor 802 then has a configuration with drain-to-gate short, and provides:

$$V_{GS2}=V_{DS2} \tag{1}$$

where $V_{GS2}$ is the gate-to-source voltage of transistor 802, and $V_{DS2}$ is the drain-to-source voltage on 802.

According to the characteristics of MOS transistors, the condition given in Eq. (1) ensures that 802 is at the onset of saturation, and the current (ID) through 802 is control by the gate voltage according to a formula:

$$I_{D2}C_2(V_{GS2}-V_{TH2})^2 \tag{2}$$

where $V_{TH2}$ is the threshold voltage of 802, and $C_1$ is a constant determined by the width, length, and intrinsic parameters such as the mobility of silicon, the thickness and dielectric constant of the gate oxide of transistor 802. Approaching the end of a scan cycle, the current branched into the capacitor 804 diminishes to zero, and the entire data current $I_W$ is channeled through transistor 802, thereby giving $$I_{D2}=I_W \tag{3}$$

It should be noted that the voltage $V_C$ on capacitor 804 is the same as $V_{GS2}$ (i.e. $V_{GS2}=V_C$) since the line voltage on 810 is at the same level as VREF in a scanning cycle.

3. Drive cycle. After data is written into a pixel and the capacitor 804 charged to a voltage $V_C=V_{GS2}$ that sets transistor 802 in saturation region, electrode 810 is raised to a voltage high ($V_{HI}$) (drive voltage) sufficient to provide a full forward bias on LED 805, and to keep transistor 801 in its saturation region. A preferred voltage high ($V_{HI}$) is typically equal to, or higher than the sum of the maximum LED forward operating voltage and the maximum voltage on a data electrode output. For a small-molecule OLED operating in 7.5 volt range, a typical NMOS TFT for drive transistor, and a dynamic data range of 3 volts, a preferred voltage high is in the range of 11-13 volts above VREF. Such a condition for $V_{HI}$ ensures that the voltage drop $V_{DS1}$ from drain to source of transistor 801, in a drive cycle, is higher than the stored voltage $V_C$ in the capacitor 804 written in a scan cycle, thereby pinning transistor 801 into its saturation region. As electrode 810 being set high, p-channel transistor 803 is turned off. Transistor 802 has its drain and source reversed from the scanning cycle as described above in the discussion related to FIG. 6, as the voltage on scan-power electrode 810 being set above the stored capacitor voltage $V_C$. Transistor 802 is thereby turned off as its gate is ground at the same potential of its source (A). This completely isolates capacitor 804 from any external influence. The charge accumulated in capacitor 804 from the scan cycle is thereby retained for as long as parasitic leakage current permits. Simultaneously, LED 805 becomes forward biased as its anode is at a positive potential relative to VREF. With the conditions provided above for $V_{HI}$, and an I-V analysis of operating conditions of transistor 801, it can be verified that $V_{DS} \geqq V_{GS}$ in a drive cycle. The transistor 801 therefore remains in the saturation region with its drain-to-source current ID following a similar expression as above:

$$I_{D1}=C_1(V_{GS1}-V_{TH1})^2 \tag{4}$$

where $I_{D1}$ is the current through 801, $C_1$ is a constant determined by the width, length, and intrinsic parameters such as the mobility of silicon, the thickness and dielectric constant of the gate oxide of transistor 801, and $V_{GS1}$ is the gate-to-source voltage of transistor 801 in a drive cycle, noting that $V_{GS1}=V_C=V_{GS2}$.

Given the close proximity between 801 and 802, all the intrinsic parameters and the thickness of oxide are expected to be fairly the same for both. That gives $V_{TH1}=V_{TH2}$, and the C's only be different through dimensional parameters of length (L) and width (W) by design. It is straightforward for those skilled in the art to conclude that the current $I_{D1}$ so delivered in a drive cycle is proportional to the input current $I_W$:

$$I_{D1}/I_W=C_1/C_2=W_1L_2/W_2L_1 \tag{5}$$

or $$I_{D1} \propto I_W$$

where $W_1$ and $W_2$ are the width and $L_1$ and $L_2$ are the length of transistor 801 and 802, respectively.

The drive method and pixel circuit provided herein thus provide a three-transistor solution to current control drive for light emitting device displays, therein eliminated the impact by the variation in characteristics of its circuit elements. The ratios of dimensional parameters in Eq. (5) are constant by design, and remain constant to the first order of process variation, thereby providing a transfer function that is not impacted by spatial fluctuation in processing. It should be noted that the linearity between the input and output is a preferred transfer characteristics, but not a necessary condition for this invention to operate. It should also be noted that the ratio $C_1/C_2$ is not necessarily the same for all current levels. A slightly higher $C_1/C_2$ at lower current $I_W$ than at higher $I_W$ is typical. This is due to the boundary condition of a constant total voltage across the light emitting element 805 and transistor 801, resulting in an increase in drain-to-source voltage $V_{DS1}$ on drive transistor 801 from $V_{DS2}$ on 802 when setting $V_C$. Such a deviation is more at lower $I_W$ than at higher $I_W$, and thus pushing 801 deeper into saturation from the onset point at lower current $I_W$. For transistors exhibit incomplete saturation, this causes an increase in $C_1$, and a deviation of the ratio $C_1/C_2$. To the first order of operation, this deviation may be neglected; for more accurate image reproduction, this deviation may be compensated in input $I_W$, or with additional offset elements.

As described hereinabove, the preferred embodiment in FIG. 8 further provides, as a first additional perspective, an illustration of a current path (P1-P2-P3-P4) connecting said scan-power electrode as a first access electrode and said data electrode as a second access electrode, via A-terminal and B-terminal of transistor 802 and the source and drain of transistor 803. Such a current path conducts a current equal to the data current in a scanning cycle. The scanning cycle is controlled by applying a scanning voltage on the scan-power electrode.

It should be noted that various electrical elements may be further inserted or divided in such a current path to further modify the operation. These further modifications shall be construed as not violating the provision of a current path between a scan-power electrode and a data electrode to incorporate a drive function into the same scan-power electrode, as described in the present invention.

The preferred embodiment of FIG. 8 provides, as a second perspective, a demonstration of the functions of terminals A and B of transistor 802 as being drain and source varying in different operating cycles. The function of A and B terminals as being drain or source is not statically fixed at the time of design of a pixel circuit, but rather alternates on the operation voltage applied on said scan-power electrode. In this respect, it is more appropriate to refer to these terminals as second and third terminals (in addition to the gate terminal) in this description and in the claims.

The preferred embodiment of FIG. 8 further provides, as a third perspective, a control circuit as provided in FIG. 6, comprising transistors 802 and 803 that convert input signal in a current form to a voltage form, and deliver such voltage to the storage capacitor 804. A current path connecting the scan-power electrode and data electrode is provided via such control circuit.

During the period when a drive voltage ($V_{HI}$) is applied to the scan-power electrode, all paths leading to the storage element 804 are inhibited, isolating the capacitor (and the gate of transistor 801) from any other influence.

An active matrix display may be constructed from the pixel unit provided in this embodiment by forming such pixels at intersects between a plurality of data electrodes and a plurality of scan-power electrodes. As an example for a complete display unit, a current driver unit with matching number of output terminals is attached to the edge of such matrix display where each data electrode is connected to an output terminal of the data driver unit to provide data current signal. A scan-power driver is attached to another edge of such display matrix where each scan-power electrode is connected to an output terminal of the scan-power driver unit to receive scanning pulses and driver current.

In a preferred implementation of the embodiment of FIG. 6, the transistors are thin film transistors (TFT) formed on a layer of amorphous or polycrystalline silicon on a transparent glass substrate. The transistors may also be form on single crystal silicon substrate, and may be either MOS or bipolar device. The common reference voltage source is typically supplied through a continuous layer 670 of conductive material connected to each and every pixel. The organic light emitting diode may be formed with a stack of layers of small-molecule or polymer organic materials. Such light emitting structure typically comprises a cathode layer, an electron-transport layer, a hole-transport layer, and an anode layer. An additional emitter layer is often provided between the electron-transport and the hole-transport layers to enhance the light producing efficiency. The data and scan-power electrodes are typically formed by first depositing or coating a layer or layers of conductive materials, and followed by a standard photolithography and etch processing techniques to define the pattern of such electrodes. In a preferred implementation, the storage element is a parallel-plate capacitor formed by sequentially preparing a first conduct layer, an insulating layer, and a second conductive layer, followed by a standard photolithography and etch processing to define a capacitor structure. A preferred method typically used to connect various device structures in a display circuit, such as the one presented in FIG. 6 of this invention, is by defining the device pattern and contact points with a photolithography and etch process. Various techniques used to produce the structures and connections needed for the implementation of the circuit in FIG. 6 are available in the art, and the examples of which are found in the documents incorporated by reference.

Figure 9:
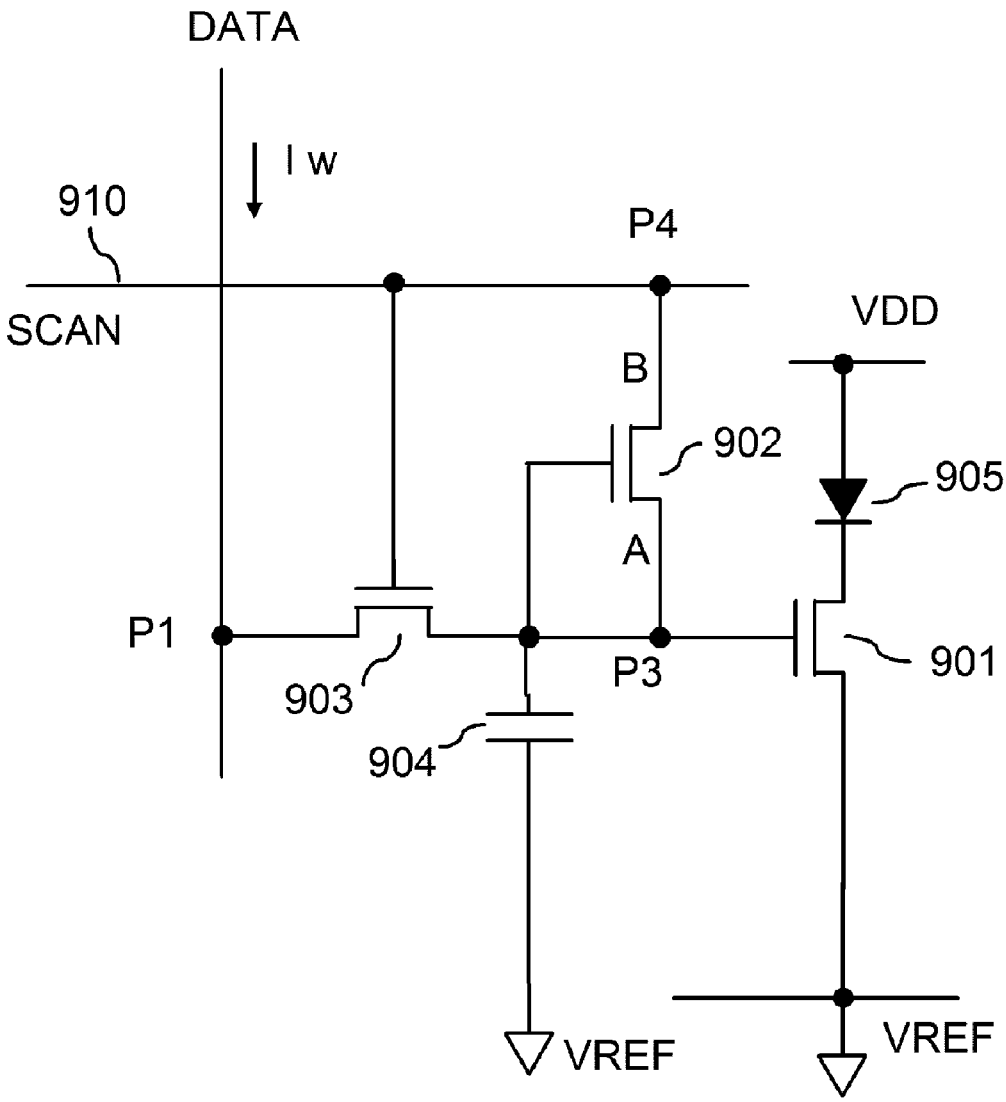
FIG. 9 is a schematic diagram of a pixel circuit in a preferred embodiment of the present invention, providing a common anode structure.

FIG. 9 provides a preferred embodiment of this invention with a separate second power source VDD. The circuit of FIG. 9 comprises a light emitting device 905, a data electrode, a scan electrode 910, a storage element 904, a drive transistor 901, a conducting channel P1 to P4 via P3 between a data electrode and a scan electrode via two transistors 902 and 903, a first voltage source VREF, and a second voltage supply VDD. For a preferred operation, the pixel circuit in FIG. 9 may be implemented with two N-channel transistors 901 and 902, and a p-channel transistor 903. A preferred application of the embodiment FIG. 9 is to operate this circuit for current control drive mode of the display. In such an operation, the scan electrode delivers a scanning signal $V_{LO}$ that is equal to or slightly lower than VREF, turning on transistor 903 in a scanning period for data input. $V_{LO}$ is set to be the lowest voltage in the system, ensuring that p-channel transistor 903 is turned on with $V_{LO}$ on its gate, and transistor 902 is forward biased with its gate connected to its drain. A data current is thus directed from data electrode to scan-power electrode according to data input. Such a data current generates a voltage at both the drain and the gate of transistor 902 according to a saturation condition of 902 as the gate and the drain of 902 are at the same voltage. This generated data voltage thus sets the voltage of capacitor 904.

In a non-select period when the data writing is directed to pixels controlled by other scanning electrodes, a logic high equal to VDD is applied to this scan-power electrode 910, turning off transistor 902 and 903. As discussed above, a preferred condition is to set VDD 11-13 volts, and set $V_{LO}$ equal to or a fractional volt below VREF, where $V_{LO}$ is set to be the lowest voltage in the system. A numerical example of such operating voltages and data range are similarly to that provided in the above example of FIG. 8.

In a scanning period, the n-channel transistor 902 is thus biased in a configuration with A node being the drain and B node being the source, and operates in its saturation region since the $V_{GS}=V_{DS}$. In a non-select period, the data electrode is isolated from the pixel as transistor 903 is in its off-state. The scanning electrode is also isolated from this pixel as B node is more positive than A node, setting transistor in a configuration where gate of 902 is short to its source, or $V_{GS}=0$. Following the same operation analysis as above for FIG. 8, the circuit of FIG. 9 provides a preferred current drive scheme with output current linearly proportional to the input current. Such a current drive is not influenced by the threshold voltage of the transistors or the forward voltage of the light emitting device 905. Noting here is that in this embodiment, the drive current is not interrupted by the data input, and is delivered continuously.

The preferred embodiment of FIG. 9 illustrates a conducting channel (from P1 to P4 via P3) between the data electrode and the scan electrode.

Said conducting channel in this embodiment comprises circuit elements so arranged that an input data current $I_D$, directed from said data electrode to said scan electrode, is converted into a data voltage by said conducting channel. Furthermore, such converted voltage is generated at the gate of a transistor 902, and sets the voltage of the storage element 904.

Furthermore, the A node of transistor 902 operates as a drain when the voltage of scan electrode 910 is set to $V_{LO}$, lower than the voltage on the data electrode.

During the period when a de-select voltage ($V_{HI}$) is applied to the scan-power electrode, all paths leading to the storage element 804 are inhibited, isolating the capacitor (and the gate of transistor 801) from any external influence.

Figure 10:
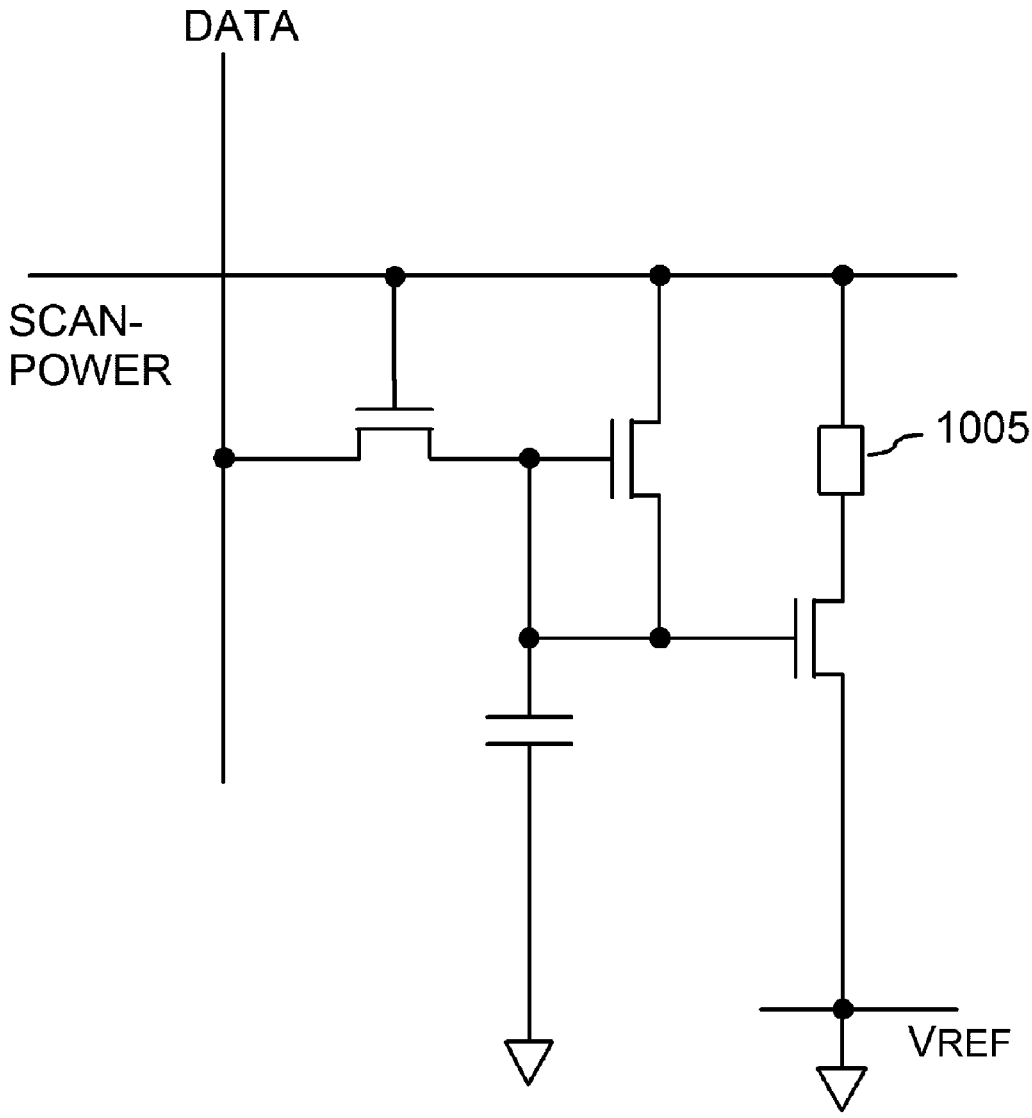
FIG. 10 is a schematic diagram of a pixel circuit in an embodiment of the present invention comprising a general type light emitting device.
Figure 11:
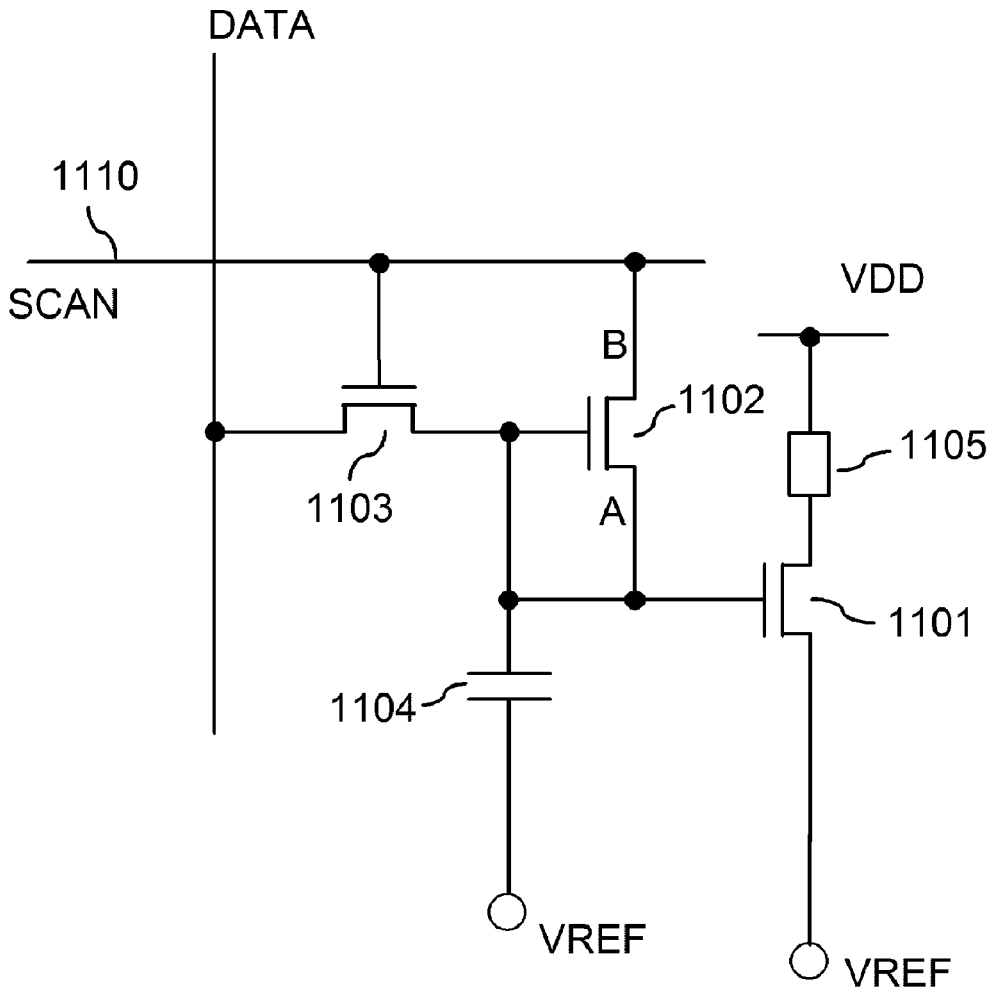
FIG. 11 is a schematic diagram of a pixel circuit in an embodiment of the present invention comprising a general type light emitting device.

The operation of pixel circuits in FIGS. 8 and 9 does not require a reliance on specific polarity of VDD, VREF, or the light emitting element to establish the described functions. Accordingly, preferred embodiments of direct extension to the applications for a more general type light emitting device are readily derived in FIG. 10 and FIG. 11, wherein 1005 and 1105 represent a light emitting device that may be either unidirectional (such as a diode) or bidirectional (Ref. U.S. Pat. No. 5,663,573). Considering FIG. 11, a common-anode structure same as FIG. 9 is obtained by providing a p-channel transistor 1103, two n-channels transistors 1101 and 1102, light emitting element 1105 with its anode connected to VDD, where VDD is more positive than VREF, a scanning voltage $V_{LO}$. Alternately, a common-cathode structure is readily obtained by assigning 1103 an n-channel transistor, two p-channels for 1101 and 1102, a VDD more negative than VREF, a LED in reverse polarity of 905, a scanning voltage $V_{HI}$ in positive direction, and a data current directed away from a pixel. In each of these implementations, the light emitting element 1105 may be assigned a bi-directional device, with an operation follows the same discussion as provided above for FIG. 9 and $V_{LO}$ set to be equal to VREF. Similar preferred assignments may be made for FIG. 10 to obtained preferred operations and configurations, following an operation in analogy to that of FIG. 8.

Figure 12:
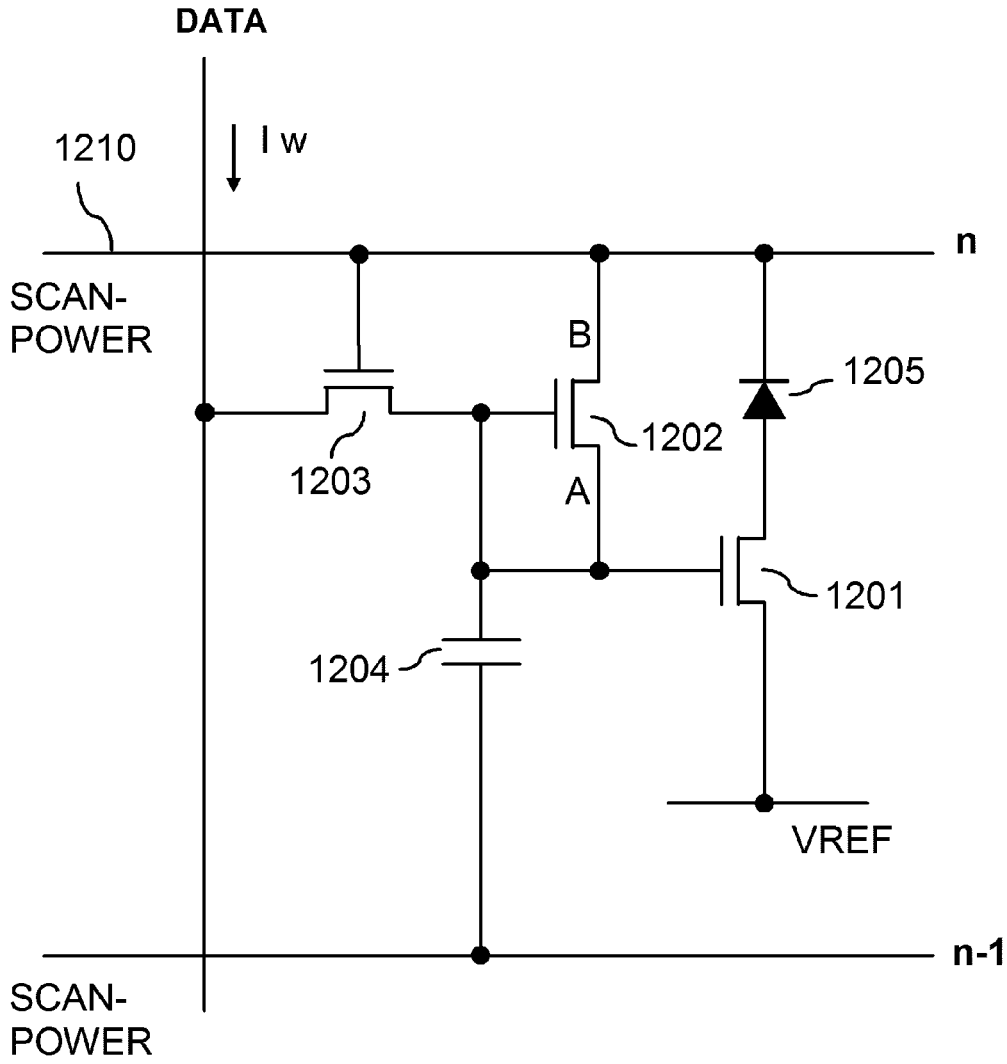
FIG. 12 is a schematic diagram of a pixel circuit in an alternate embodiment of the present invention.

A further extension of the present invention provides a configuration using a different voltage reference for storage capacitor. FIG. 12 illustrates a preferred embodiment of a pixel circuit wherein one terminal of capacitor 1204 is connected to one of the two adjacent scan-power electrodes. The pixel circuit in FIG. 12 comprises an n-channel transistors 203, two p-channel transistors 1201 and 1202, a scanning voltage $V_{HI}$, a VREF equal to $V_{HI}$, a drive voltage $V_{LO}$, and a data current directed away from a pixel. The operation of pixel circuit in FIG. 12 can be understood in the same framework as of FIG. 8. The scanning voltage pulse $V_{HI}$ is applied to the scan-power electrodes sequentially. During a scanning cycle for the $n^{th}$ row, the $(n-1)^{th}$ scan-power electrode is at $V_{LO}$. The reference voltage for data writing in storage capacitor 1204 is $V_{LO}$ that gives a DC shift in capacitor voltage, but does not affect the gate voltage at 1201 that represents a saturation condition for transistor 1202 in a data writing period and a saturation point for transistor 1201 in a drive period. This DC shift increases the voltage across the storage capacitor 1204, but no operational difference otherwise. By coupling the capacitor with an adjacent scan-power electrode, the capacitor structure may be implemented under the scan-power electrode and thus achieve a higher efficiency in area utilization. The storage capacitor in this pixel circuit can be formed with a scan-power electrode conductor as part of the capacitor structure. An example of this is a capacitor formed underneath a scan electrode along one side of a pixel, having a thin layer of dielectric material formed between the scan electrode and another conductive layer underneath.

Figure 13:
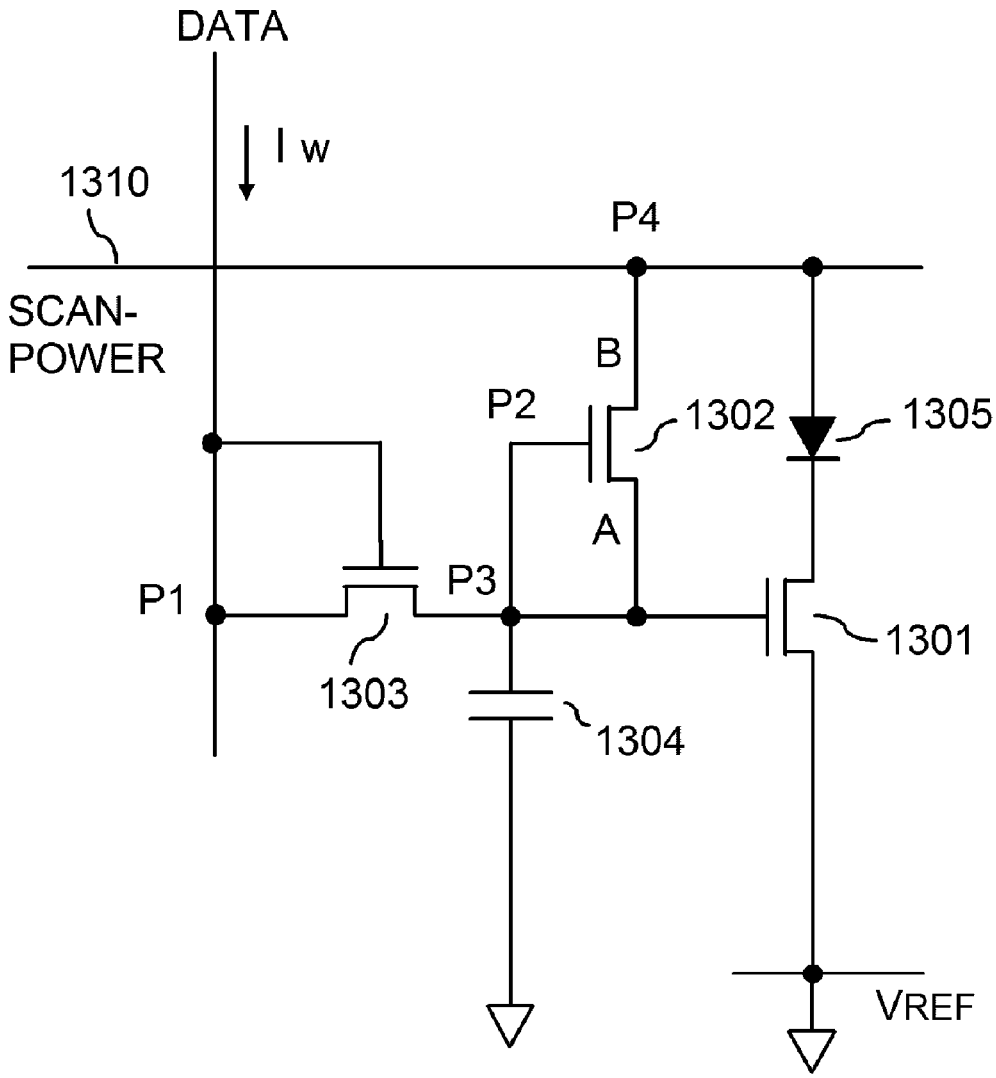
FIG. 13 is a schematic diagram of a pixel circuit in another preferred embodiment of the present invention.

FIG. 13 provides another preferred embodiment of the present invention, where the conducting channel from data electrode to scan-power electrode comprises two transistors 1302 and 1303. This preferred embodiment comprises the circuit element of FIG. 7A, providing a conducting channel from the data electrode to the scan-power electrode. For a preferred mode of operation, the two transistors are arranged with their gate terminals connected to a second terminal of each of the transistors as depicted in FIG. 13. The operating procedure is similar to that described for FIG. 8. A scanning voltage low is applied to select the pixels for data writing. Such a voltage low is equal to or slightly lower than VREF, and is set to be the lowest operating voltage in such display system. In a data writing period when such a voltage low scanning signal is applied to the scan-power electrode, both N-channel transistors 1302 and 1303 are set to the saturation condition since their gate terminals are now connected to their drain terminals. Furthermore, a voltage corresponding to the gate voltage driving N-channel transistor 1302 in its saturation mode to deliver the data current is generated at the gate of 1302, and sets the voltage of capacitor 1304. In a drive period when a voltage high, VDD, is applied to the scan-power electrode, N-channel transistor 1301 becomes forward biased and drives a similar saturation current proportional to the input data current, as described in the above analysis provided for FIG. 8.

Figure 14:
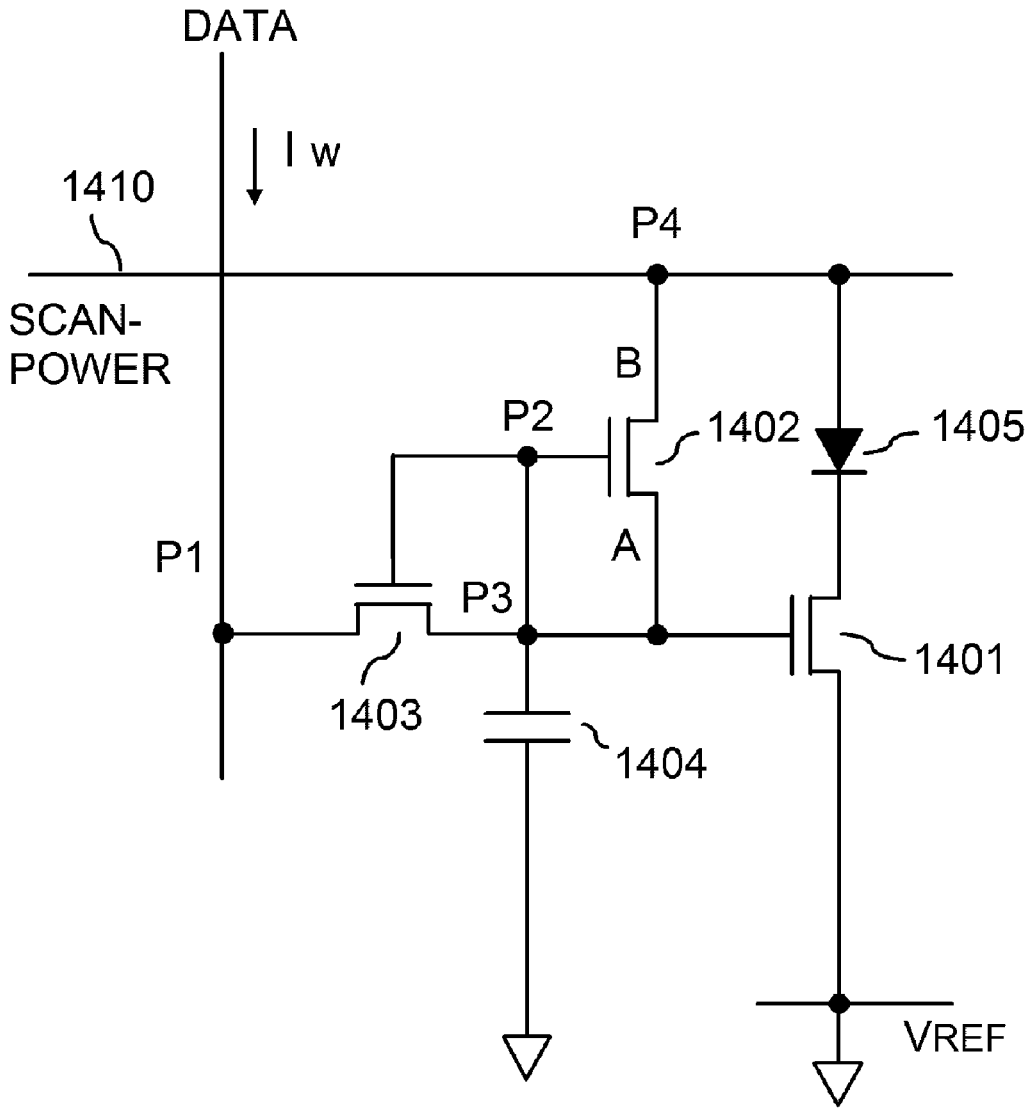
FIG. 14 is a schematic diagram of a pixel circuit in another preferred embodiment of the present invention.

FIG. 14 provides another preferred embodiment comprising two N-channel transistors 1401 and 1402, and a p-channel transistor 1403. The wiring of p-channel transistor 1403 allows the scan-power electrode to turn 1403 on and off the same manner as the turning on and off of transistor 1303 by the scan-power electrode. The remaining operation procedure and the relation between output drive current and input data current are similar to that for FIG. 13 and for FIG. 8. This preferred embodiment utilizes the element of FIG. 7B, providing a conducting channel from the data electrode to the scan-power electrode.

The present invention is described herein with specific combinations of transistors and polarity of OLED in each embodiment. Examples of the preferred embodiments illustrate a drive scheme and principles to implement pixel circuit using a basic circuit element of FIG. 6 and to benefit from such drive scheme. Variances and extensions are expected to be derived from these embodiments, and by practicing the principles provided herein, but still within the scope of the present invention. For example, an implementation involving four transistors in a pixel while utilizing the drive method and circuit element of FIG. 6 falls well within the scope of the present invention. It is also well recognized by those skilled in the art that the functions of circuits in all embodiments of FIGS. 8-14 are not restricted by the property of light emitting element in the circuits and the polarity of supply voltages. For example, the circuit in FIG. 12 performs equally well and achieves the same merit discussed therein when OLED 1205 reverses its polarity, or is replaced by a bi-directional light emitting device. As another example, the storage capacitor in the embodiments of FIGS. 9 and 10 may be constructed by connecting to an adjacent scan-power electrode, similar to that illustrated in FIG. 12.

Furthermore, inserting resistors or capacitors at various nodes in the circuit provided hereinbefore to pre-condition a signal, modify its transient property, or provide fine adjustment of voltage drop, as commonly practiced in the art, while leaving the basic circuit operation the same as discussed in this disclosure falls well within the scope of the present invention.

Although various embodiments utilizing the principles of the present invention have been shown and described in detail herein, those skilled in the art can readily devise many other variances, modifications, and extensions that still incorporate the principles disclosed in the present invention. The scope of the present invention embraces all such variances, and shall not be construed as limited by the number of active elements, wiring options of such, or the polarity of a light emitting device therein.

What is claimed is:

1. A display comprising at least:

a data electrode for delivering input data;

a scan electrode; said scan electrode delivering at least a first signal and a second signal in operating said display;

a first voltage supply VREF;

a second voltage supply;

a pixel disposed at the intersect of said scan electrode and said data electrode;

said pixel comprising:

a light emitting element, wherein said light emitting element emits light according to electrical current supplied thereto;

a storage element for holding data information, having a first end and a second end;

a control circuit for regulating a current directed to said light emitting element according to said data information; and wherein said scan electrode controls the data input from said data electrode to said storage element by carrying said first signal and said second signal; wherein said first signal enables data input, allowing a data signal to be passed from said data electrode to said storage element via said control circuit; and wherein said second signal inhibits data transfer between said data electrode and said storage element, isolating said storage element from external signals;

wherein said control circuit further comprises a first conducting channel for conducting electrical current between said data electrode and said scan electrode via said control circuit;

wherein, in operating said display, said first conducting channel is enabled by applying said first signal to said scan electrode;

wherein, in operation of said display, said first conducting channel is inhibited by applying said second signal to said scan electrode;

wherein said first conducting channel, when enabled, provides a direct current path between said data electrode and said scan electrode.

2. The display according to claim 1, wherein said first conducting channel conducts a data current when enabled.

3. The display according to claim 2, wherein said first conducting channel, when enabled, conducts a data current between said data electrode and said scan electrode, and wherein said first conducting channel converts said data current to a data voltage at said first end of said storage element.

4. The display according to claim 3, wherein said first conducting channel further comprises a switching element having a high-impedance gate; said data voltage being converted at said high impedance gate.

5. The display according to claim 1, wherein said first conducting channel comprises a switching element having a high-impedance control terminal, a second terminal, a third terminal, and a channel between said second and said third terminals; wherein said channel between said second and third terminals forms part of said first conducting channel.

6. The display according to claim 5, wherein said switching element is a transistor; wherein said transistor converts a data current to a data voltage at the gate of said transistor; said data current being directed along said first conducting channel during the period when said first signal is applied to said scan electrode.

7. The display according to claim 5, wherein said switching element being a transistor; wherein said second terminal operates as a source or emitter when said first conducting channel is enabled, and wherein said second terminal operates as a drain or collector when said first conducting channel is inhibited.

8. The display according to claim 1, wherein said first conducting channel further comprises a transistor having a gate, and two other terminals operating as source and drain; wherein the voltage at said gate is equal to the voltage at said drain when said first conducting channel is turned on.

9. The display according to claim 8 wherein said voltage at said gate is equal to the voltage at said source when said first conducting channel is turned off.

10. The display according to claim 1, wherein said first conducting channel comprises a first transistor and a second transistor; wherein each of said transistors comprises a gate and two other terminals operated as source and drain; wherein the gate and the drain are at the same voltage for both transistors when said first conducting channel is enabled, and wherein the gate and the source are at the same voltage for both transistors when said first conducting channel is inhibited.

11. The display according to claim 1, wherein said first conducting channel comprises a first transistor and a second transistor; wherein each of said transistors comprises a gate, a second terminal and a third terminal; wherein said second terminal operates as a drain in both transistors when said first conducting channel is enabled; and wherein said second terminal operates as a source in both transistors when said first conducting channel is inhibited.

12. The display according claim 1, wherein said control circuit further comprises a second conducting channel between said scan electrode and said first voltage supply via said light emitting element; wherein said scan electrode directs a drive current along said second conducting channel during the period when said second signal is applied to said scan electrode; said scan electrode hereinafter being more specifically named as scan-power electrode.

13. The display according to claim 12, wherein said second conducting channel is inhibited by said scan-power electrode carrying said first signal.

14. The display according to claim 13, wherein said first conducting channel is inhibited by said scan-power electrode carrying said second signal.

15. The display according to claim 14, wherein said first conducting channel sets a data voltage at said storage element during the period when said first conducting channel is enabled by applying said first signal to said scan-power electrode; wherein said first conducting channel converts a data current directed from said data electrode to said scan-power electrode to said data voltage during the period when said first conducting channel is enabled.

16. The display according to claim 12, wherein said first conducting channel sets a data voltage at said storage element during the period, when said first conducting channel is enabled by applying said first signal to said scan-power electrode; wherein said data voltage is generated by said first conducting channel while directing a data current along said first conducting channel.

17. The display according to claim 12, wherein said first conducting channel comprises a transistor having a high-impedance control terminal, a second and a third terminals; wherein said transistor converts a data current directed from said data electrode to said scan-power electrode during the period when said first signal is applied to said scan-power electrode to a data voltage at said high-impedance control terminal of said transistor.

18. The display according to claim 17, wherein said data voltage sets the voltage of said storage element.

19. The display according to claim 12, wherein said first conducting channel comprises a first transistor having a gate terminal, a second and a third terminals; wherein said second terminal operates as a source when said first conducting channel is enabled, and wherein said second terminal operates as a drain when said first conducting channel is inhibited.

20. The display according to claim 12, wherein said first conducting channel further comprises a transistor having a gate and two other terminals operate as source and drain; wherein the voltage at said gate is equal to the voltage at said drain when said first conducting channel is turned on, and wherein the voltage at said gate is equal to the voltage at said source when said first conducting channel is turned off.

21. The display according to claim 1, wherein said first conducting channel comprises a first transistor and a second transistor; wherein each of said transistors comprises a gate, a second terminal and a third terminal; wherein said second terminal operates as a drain in both transistors when said first conducting channel is enabled; and wherein said second terminal operates as a source in both transistors when said first conducting channel is inhibited.

22. The display according to claim 12, wherein said first conducting channel comprises a first transistor and a second transistor; wherein each of said transistors comprises a gate and two other terminals operated as source and drain; wherein the voltage at the gate is equal to the voltage at the drain for both transistors when said first conducting channel is enabled, and wherein the voltage at the gate is equal to the voltage at the source for both transistors when said first conducting channel is inhibited.

23. The display according to claim 12, wherein said second conducting channel comprises a drive transistor; wherein said drive transistor regulates said drive current directed from said scan-power electrode to said first voltage supply via said light emitting element and said drive transistor, according to a data voltage stored at said storage element.

24. The display according to claim 23, wherein said drive transistor comprises a gate, a second terminal and a third terminal; wherein said gate is connected to said storage element.

25. A display comprising at least:

a data electrode for delivering input data;

a scan electrode; said scan electrode delivering at least a first signal and a second signal in operating said display;

a first voltage supply VREF;

a pixel disposed at the intersect of said scan electrode and said data electrode;

said pixel comprising:

a light emitting element, wherein said light emitting element emits light according to electrical current supplied thereto;

a storage element for holding data information, having a first end and a second end;

a control circuit for regulating a current directed to said light emitting element according to said data information;

wherein said scan electrode regulates the data input from said data electrode to said storage element by carrying said first signal and said second signal; wherein said first signal enables data input, allowing a data information to be received at said storage element from said data electrode via said control circuit; and wherein said second signal inhibits data transfer between said data electrode and said storage element, isolating said storage element from external signals;

wherein said control circuit, when enabled, comprises a direct current path between said data electrode and said scan electrode;

wherein said control circuit further converts a data current that is directed from said data electrode to said scan electrode via said direct current path, into a data voltage; wherein said data voltage sets the voltage at said storage element; said data voltage being said data information held by the storage element.

26. The display according to claim 25, wherein said control circuit further comprises an active element having at least a high-impedance control terminal, a second terminal and a third terminal; wherein said data voltage is converted at said high-impedance control terminal.

27. The display according to claim 26, wherein said high-impedance control terminal is set at the same voltage as said second terminal.

28. The display according to claim 12 comprising a plurality of data electrodes, a plurality of scan-power electrodes, a plurality of pixels; said method comprising steps of:

applying a scanning signal to a scan-power electrode to select pixels connected to said scan-power electrode to receive data information;

directing a data current in the form of current signal to each data electrode;

applying a second signal to each scan-power electrode, inhibiting data transfer between a data electrode and a said selected pixel; delivering drive current to said pixels via said scan-power electrode.

29. The display according to claim 1, wherein said first conducting channel comprises a first transistor and a second transistor; wherein each of said transistors comprises a gate and two other terminals operated as source and drain; wherein the voltage at the gate is equal to the voltage at the drain for both transistors when said first conducting channel is enabled, and wherein the voltage at the gate is equal to the voltage at the source for both transistors when said first conducting channel is inhibited.

30. The display according to claim 1, wherein said first conducting channel comprises a first transistor and a second transistor; wherein each of said transistors comprises a gate, a second terminal, and a third terminal;

wherein said gate of said first transistor is connected to said gate of said second transistor.

31. A display comprising at least:

a pixel;

a data electrode for delivering data information to said pixel;

a scan electrode for selecting pixels to receive said data information;

said pixel comprising a data setting circuit;

wherein said data setting circuit connects said data electrode and said scan electrode; said data setting circuit comprising:

a first transistor comprising a gate, a second terminal, and a third terminal;

a second transistor comprising a gate, a second terminal and a third terminal;

wherein said gate of said first transistor is directly connected in common with said second terminal of said first transistor and said second terminal of said second transistor;

wherein said data setting circuit connects said data electrode and said scan electrode via said third terminal of said second transistor, said second terminal of said second transistor, and said third terminal of said first transistor.

32. The display according to claim 31, wherein said gate of said second transistor is connected to said scan electrode.

33. The display according to claim 31, wherein said gate of said second is connected to said third terminal of said second transistor.

34. The display according to claim 31, wherein said gate of said second transistor is connected to second terminal of said second transistor.

35. A display comprising at least:

A pixel;

A data electrode for delivering data information to said pixel;

A scan electrode for selecting said pixel to receive said data information; said scan electrode delivering at least a first signal and a second signal to said pixel in operation of said display; wherein said scan electrode carrying said first signal to enable said pixel to receive said data information;

A reference voltage source;

A storage element for holding a data voltage;

Said pixel further comprising:

A data setting circuit connecting said data electrode and said scan electrode; wherein said data setting circuit generates said data voltage from said data information during the data setting period when said pixel is enabled to receive said data information;

Wherein said data circuit provides a conducting channel to conduct a direct current directed from said data electrode to said scan electrode during a data setting period.

36. The display according to claim 35, wherein said data setting circuit comprises a transistor having a gate terminal, a second terminal, and a third terminal;

Wherein transistor generates said data voltage at said gate of said transistor during a data setting period.

37. The display according to claim 1, wherein said first conducting channel, when enabled, provides a direct current path between said data electrode and said scan electrode.

* * * * *